US009303932B1

(12) United States Patent
Jackson

(10) Patent No.: US 9,303,932 B1
(45) Date of Patent: Apr. 5, 2016

(54) FIREARM WITH BOTH GAS DELAYED AND STROKE PISTON ACTION

(71) Applicant: The United States of America as Represented by the Secretary of the Army (U.S. Army), Washington, DC (US)

(72) Inventor: Paul T. Jackson, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/534,286

(22) Filed: Nov. 6, 2014

(51) Int. Cl.
*F41A 5/18* (2006.01)

(52) U.S. Cl.
CPC ..... *F41A 5/18* (2013.01)

(58) Field of Classification Search
CPC ..... F41A 5/18; F41A 5/26; F41A 5/24
USPC ..... 89/191.01–194
See application file for complete search history.

(56) References Cited

U.S. PATENT DOCUMENTS

| | | | | | |
|---|---|---|---|---|---|
| 502,549 | A | | 8/1893 | Browning | |
| 544,660 | A | | 8/1895 | Browning | |
| 1,713,955 | A | * | 5/1929 | Destree | F41A 5/26 89/192 |
| 1,735,160 | A | * | 11/1929 | Destree | F41A 5/26 89/190 |
| 1,846,993 | A | * | 2/1932 | Destree | F41A 5/26 89/193 |
| 1,907,163 | A | | 5/1933 | White | |
| 2,119,169 | A | | 5/1938 | Lauf | |
| 2,777,366 | A | * | 1/1957 | Cook | F41A 5/26 89/191.01 |
| 3,715,955 | A | * | 2/1973 | Folley | F41A 5/18 89/1.2 |
| 4,085,654 | A | * | 4/1978 | Panigoni | F41A 5/26 89/191.02 |
| 6,374,720 | B1 | * | 4/2002 | Tedde | F41A 1/06 42/78 |
| 8,950,313 | B2 | * | 2/2015 | Kenney | F41A 5/28 89/193 |

FOREIGN PATENT DOCUMENTS

| | | |
|---|---|---|
| GB | 626374 | 8/1945 |

OTHER PUBLICATIONS

The Editor; "Actions: Gas Operated: Long Stroke Piston"; Firearms History, Technology & Development; Oct. 17, 2010; http://firearmshistory.blogspot.com/2010/10/actions-gas-operated-long-stroke-piston.html.

(Continued)

*Primary Examiner* — Reginald Tillman, Jr.
(74) *Attorney, Agent, or Firm* — William B Haymond

(57) ABSTRACT

A firearm including a barrel, a bolt, a piston, a connecting arm, a rear gas port, a rear piston area, a forward gas port having a greater diameter than the rear gas port, a forward piston area, and an ammunition cartridge including a primer, powder and a bullet; the propellant gas from the explosion of the cartridge first exerting pressure from the rear piston area to keep the bolt in a forward position after firing of the bullet; when the bullet approaching the barrel exit, the forward gas port's larger diameter in comparison to the rear gas port allowing the propellant gas pressure from the forward piston area to overpower the propellant gas pressure from the rear piston area, forcing the piston and the bolt rearward, the bolt in its rearward movement functioning to extract and eject the empty cartridge from the firearm after barrel pressure returns to near ambient.

9 Claims, 6 Drawing Sheets

(56) References Cited

OTHER PUBLICATIONS

The Editor; "Actions: Gas Operated: Short Stroke Piston"; Firearms History, Technology & Development; Oct. 14, 2010; http://firearmshistory.blogspot.com/2010/10/actions-gas-operated-short-stroke.html.

The Editor; "Actions: Blowback Action: Gas Delayed"; Firearms History, Technology & Development; Aug. 24, 2010; http://firearmshistory.blogspot.com/2010/08/actions-blowback-action-gas-delayed.html.

* cited by examiner

FIREARM WITH BOTH GAS DELAYED AND STROKE PISTON ACTION

BACKGROUND

Early automatic firearms relied on simple springs and used the gun's recoil to extract and then load another round.

In some high powered automatic firearms, a gas-operated long, short or direct piston has been used as a safe method to unlock the firearm's empty cartridge extraction mechanism. This is often referred to as "stroke piston action." In these gas-operated piston designs, the bolt controlling the extraction mechanism is usually mechanically locked within the firearm's receiver. Upon firing, after a short delay, the rearward movement of a piston, acted upon by the pressure of propellant gases from the barrel will unlock and move the bolt to facilitate the extraction of the empty cartridge.

To properly extract and eject an empty cartridge from an automatic high powered rifle with a long, short, or direct stroke piston action, an elaborate locking mechanism is often necessary to bring about the slight delay, necessary for safety, after the round has been fired. In such firearms, although pressure from propellant gases is involved in the mechanism of activating empty cartridge extraction, such pressure from propellant gases is not also involved in the delaying of empty cartridge extraction. Rather, mechanical means are used to delay empty cartridge extraction.

Alternatively, with the development of high-powered rifle cartridges, gunsmiths have also attempted to use a system sometimes referred to as the "gas-delayed system". This system employs the propellant gases from the exploded cartridge to trigger a locking mechanism to delay the cartridge's extraction. Such a gas-delayed system allows for the pressure in the barrel to return to ambient before empty cartridge extraction is activated. In such "gas-delayed system" firearms, the pressure from propellant gases has only been used in the mechanism of delaying the start of empty cartridge extraction. It has not been used to also activate empty cartridge extraction in such "gas-delayed system" firearms. It is often the case in these firearms that only the bolt's inertia is used to activate empty cartridge extraction.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1A:
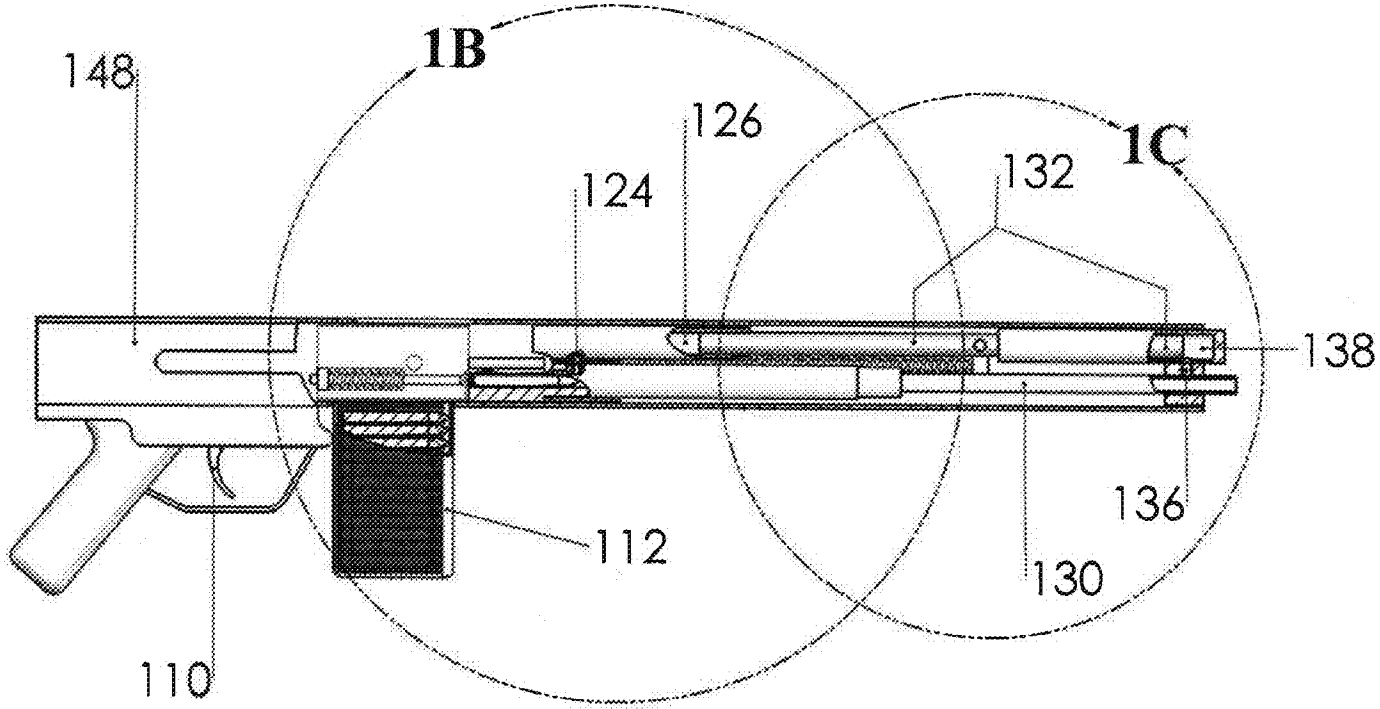
FIG. 1A is an external overview from the side of a first embodiment of a firearm according to the present application.

In the present application, the inventor has included both the principles of gas-delayed action and the principles of stroke piston action. By combining these two actions in one firearm, a simpler, less expensive, high powered automatic firearm has been created. This reliable firearm combining both gas-delayed and stroke piston designs has a simple and easily created bolt and receiver with no complicated locking lugs, delaying levers or roller delays. The firearm of this application has proven quite reliable and drastically reduces the costs and manufacturing difficulties associated with standard high powered automatic rifles.

Such a dual design, having both gas-delayed action and stroke piston action in one automatic high-powered rifle, has produced good results. The action works on the principle of propellant gas pressure from the barrel. The propellant gas is used first to hold the bolt forward and closed, while the bullet is in the barrel ("the delaying function"), and then, second, to push the bolt rearward, releasing the cartridge ("the releasing function"), when the bullet has left the barrel and the barrel pressure has returned to a near ambient state. The delaying function is performed by propellant gases entering the rear gas port immediately after firing. The propellant gases rush from the rear gas port into the rear piston area and force/hold forward the piston and the bolt, the bolt being directly connected to the piston via a connecting arm. While the bullet is traveling down the barrel, the bolt and cartridge are held securely in this forward position and no propellant gases escape the firearm rear breach. Once the bullet reaches the forward gas port, near the front of the barrel, propellant gases begin to fill the forward piston area through the forward gas port, countering the propellant gas pressures still exerting some forward pressure from the rear gas port. The forward gas port hole diameter is larger than the rear gas port hole diameter. This larger forward gas port hole diameter allows for more rearward pressure than forward pressure to be exerted on the piston once the bullet has reached the end of the barrel. The exact diameter ratio of the forward and rear gas ports is tailored according to the caliber of the firearm.

As the bullet nears the exit of the barrel, the releasing function is performed by propellant gases coming into the forward gas port and gathering at the front of the piston in the forward piston area. The higher pressures formed by these propellant gases in the forward piston area force the piston rearward, resulting in the bolt attached to the piston being pushed rearward. When the bolt begins to be pushed rearward, the chamber pressures are returning to normal and the process of empty cartridge extraction can now be safely performed by the bolt. Once the bolt has been pushed completely rearward, the discharged empty cartridge is extracted and ejected. The main recoil spring(s) then pushes the bolt forward again, enabling the bolt to pick up another cartridge from the magazine. The force from the recoil spring also enables the bolt to push the new cartridge into position in the barrel for the next shot.

The present application allows for the creation of a high powered automatic or semi automatic rifle, carbine or pistol. This simple and inexpensive, dual-design, automatic firearm, having both gas-delayed action and stroke piston action, eliminates the need for elaborate mechanical structures to mechanically lock or delay the inertial movement of bolt rearward.

FIG. 1A is an external overview from the side of a first embodiment of an entire firearm body according to the present application. The firearm includes the back of the gun with a generic trigger mechanism 110. Besides a view of the receiver 148 at the back of the gun, FIG. 1A includes an overview of the midsection (1B) of the firearm including the generic caliber specific magazine 112, the rear gas port 124 and the rear piston area 126 (all shown in more detail in FIG.

1B), and an overview of the front section (1C) of the firearm, including the barrel 130, the piston 132, the forward gas port 136 and the forward piston area 138 (all shown in more detail in FIG. 1C) all contained within the receiver 148.

Figure 1B:
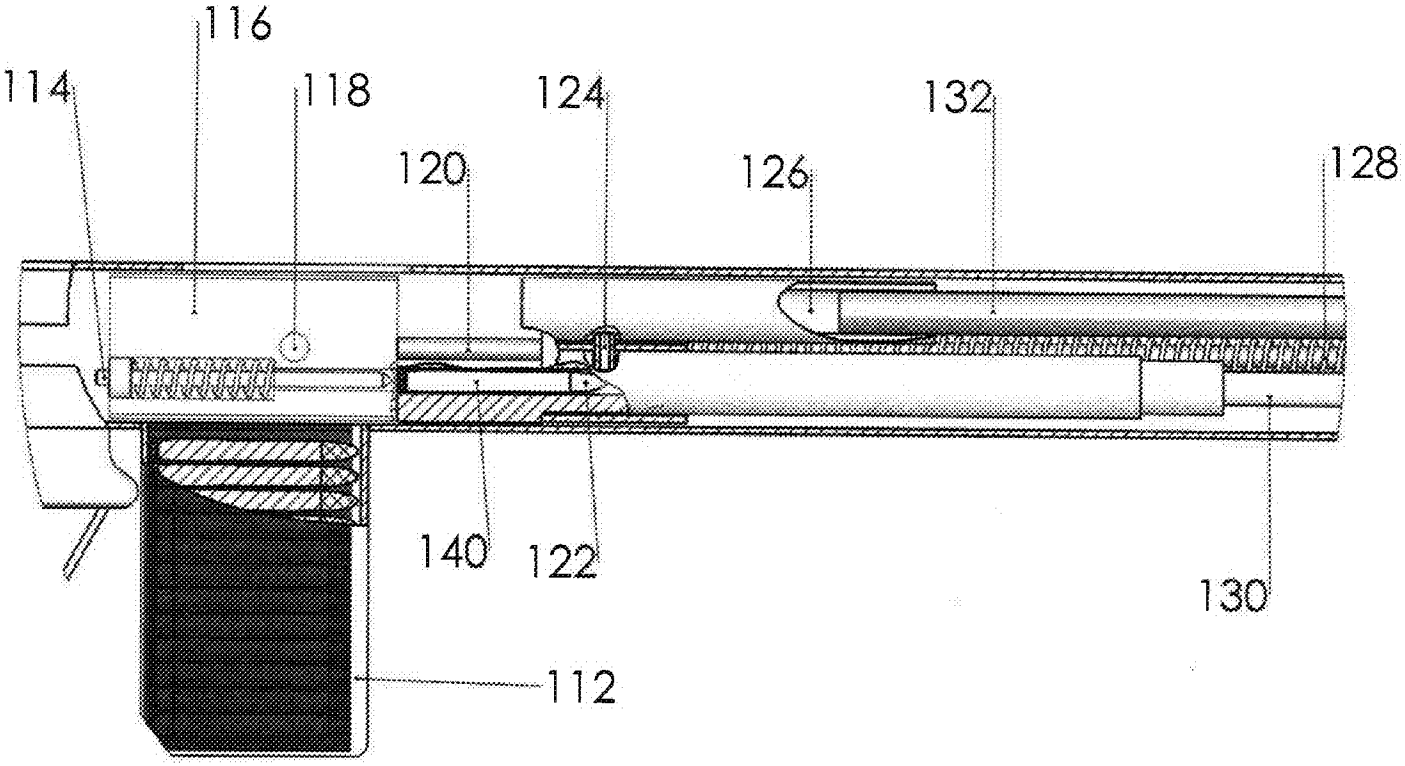
FIG. 1B is a close-up view of the midsection of the first embodiment of the firearm of FIG. 1A.

FIG. 1B is a close-up view of the midsection (1B) from the side of the first embodiment of the firearm of FIG. 1A. The midsection (1B) of the firearm comprises a magazine 112, a barrel 130, a firing pin 114, a bolt 116, a bolt handle 118, a connecting arm 120, recoil springs 128, a rear gas port 124, a rear piston area 126, a piston 132, and a bullet 122 incorporated into a cartridge 140.

Figure 1C:
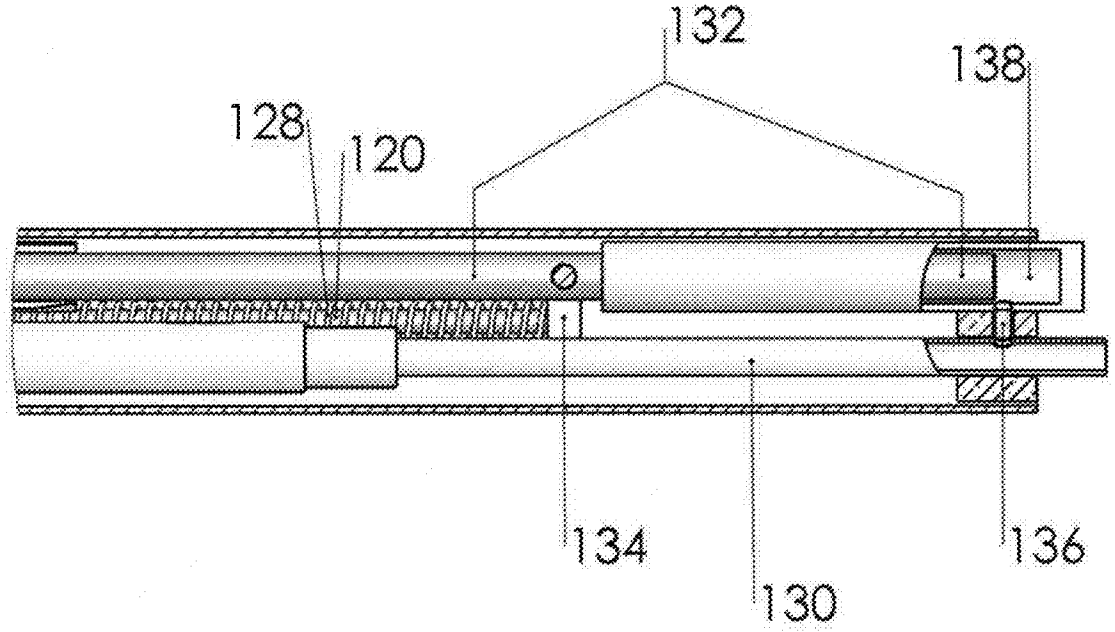
FIG. 1C is a close-up view of the front section of the first embodiment of the firearm of FIG. 1A.

FIG. 1C is a close-up view of the front section (1C) from the side shown in the first embodiment of the firearm of FIG. 1A, which view overlaps with the close-up view of the midsection (1B) of FIG. 1B. The front section (1C) of the firearm comprises a barrel 130, a piston 132, a piston arm connector 134, a connecting arm 120, recoil springs 128, a forward gas port 136 and a forward piston area 138.

Figure 2:
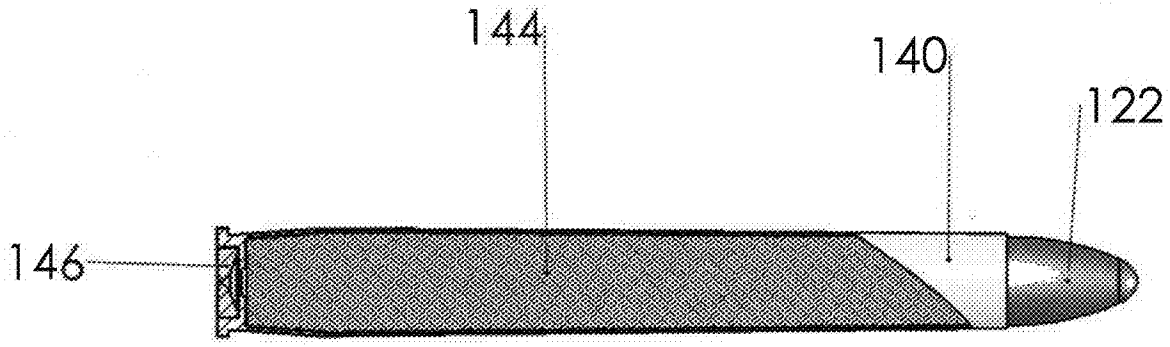
FIG. 2 is a side view drawing of the internal workings of a standard ammunition cartridge.

FIG. 2 is a side view drawing of the internal workings of a standard ammunition cartridge 140 with a bullet 122. The bullet 122 is held by the cartridge 140, which is shown lying on its side with the bullet 122 pointing right. Behind the bullet 122, the cartridge 140 is filled with gunpowder 144. In the rear of the cartridge 140 is situated the primer 146.

Figure 3:
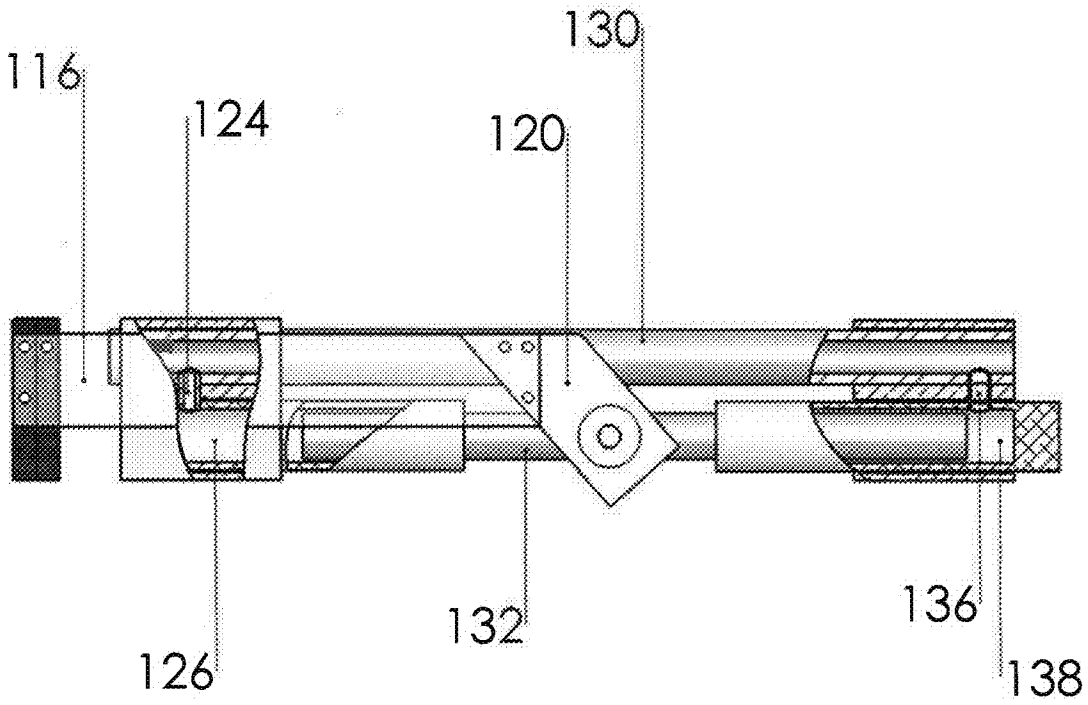
FIG. 3 is a side view drawing of a second embodiment of a firearm according to the present application.

FIG. 3 is a side view drawing of a second embodiment of the firearm according to the present application. The side view drawing of the second embodiment includes a bolt device 116 connected to a connecting arm 120, a barrel 130, a rear piston area 126, a rear gas port 124, a piston 132, a forward piston area 138 and a forward gas port 136.

Figure 4:
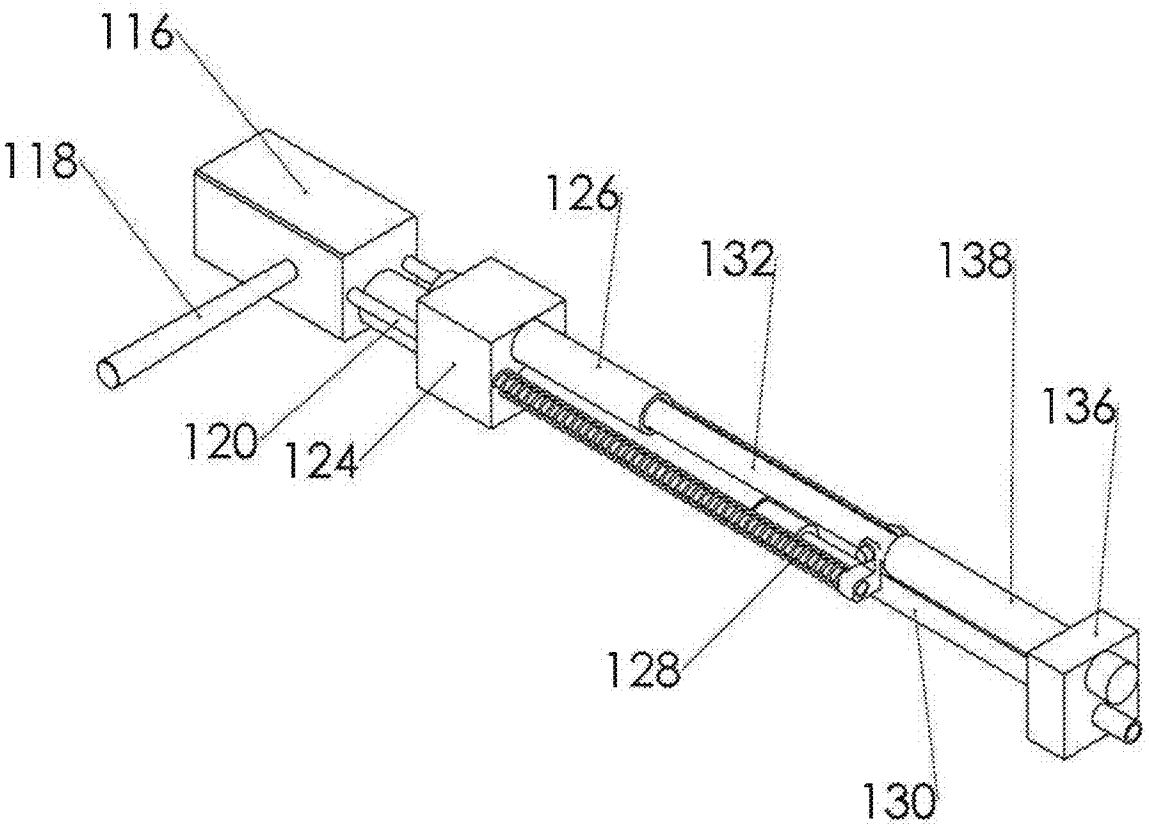
FIG. 4 is a schematic drawing of an internal view of the first embodiment of the firearm according to the present application.

FIG. 4 is a three dimensional view of a schematic drawing of the internal components in the first embodiment shown in FIGS. 1A, 1B, and 1C of the firearm according to the present application. The three dimensional view of the first embodiment of FIG. 4 comprises a bolt 116 and a bolt handle 118, a connecting arm 120, a piston 132, a rear piston area 126, a forward piston area 138, a rear gas port 124, a forward gas port 136, a barrel 130 and recoil spring(s) 128.

The present application relates to a firearm with both gas-delayed and stroke piston action; the firearm comprising a barrel 130, a bolt 116, a receiver 148, a piston 132, a piston connector 134, a connecting arm 120, recoil springs 128, a rear gas port 124, a rear piston area 126, a trigger mechanism 110, a firing pin 114, a forward gas port 136 having a greater diameter than the rear gas port 124, and a forward piston area 138, all contained within the receiver 148; and an ammunition cartridge 140 including a primer 146, powder 144 and a bullet 122. When the trigger mechanism 110 is manually activated, the firing pin 114 strikes the primer 146 from behind the cartridge 140, the striking of the primer 146 causing an explosion of the powder 144, a firing of the bullet 122 from the cartridge 140, and a generating of propellant gas in the barrel 130, the bullet 122 separating from the cartridge 140 and being propelled through the barrel 130. When pressure from the propellant gas generated by the explosion of the powder 144 in the cartridge 140 flows into the rear gas port 124 and the rear piston area 126, the propellant gas pressure from the rear piston area 126 forces and holds the piston 132, the connecting arm 120 and the bolt 116 in a forward position, the piston 132 being physically connected to the bolt 116 by the connecting arm 120 and the piston connector 134, thus the inertial rearward movement of the bolt 116 is delayed due to the propellant gas pressure from the rear piston area 126 keeping the bolt 116 in a forward position immediately after firing of the bullet 122 until the propellant gas pressure in the barrel 130 reaches the forward gas port 136 and the propellant gas pressure in the barrel 130 returns to near ambient. When the bullet 122 approaches the barrel 130 exit, propellant gas rushes from the barrel 130 through the forward gas port 136 and into the forward piston area 138, the propellant gas thus moving rearward and the larger diameter of the forward gas port 136 in comparison to the rear gas port 124 allowing the propellant gas pressure from the forward piston area 138 to overpower the propellant gas pressure from the rear piston area 126, with the propellant gas pressure from the forward piston area 138 forcing the piston 132 and the bolt 116 rearward, the bolt 116 in its rearward movement functioning to extract and eject the empty cartridge 140 from the firearm. Once the bolt 116 is forced completely rearward, the bolt 116 is then forced forward by the recoil springs 128; the forward-moving bolt 116 picking up another ammunition cartridge 140 from the magazine 112, and the bolt 116 and the cartridge 140 being seated for another shot.

In another embodiment of the firearm, the firearm further comprises a bolt handle 118 connected to the bolt 116 to enable manually pulling the bolt 116 rearward in the firearm to facilitate initial loading and/or chamber inspection.

In another embodiment of the firearm, the firearm is selected from a group consisting of an automatic rifle, a semi-automatic rifle, an automatic carbine, a semi-automatic carbine, an automatic pistol, and a semi-automatic pistol.

The present application also relates to a method of using propellant gases generated from shooting a bullet 122 from a firearm to achieve both gas-delayed and stroke piston action; the firearm including a barrel 130, a bolt 116, a rear gas port 124, a rear piston area 126, a piston 132, a trigger mechanism 110, a receiver 148, a firing pin 114, a forward gas port 136 having a greater diameter than the rear gas port 124, a forward piston area 138, and an ammunition cartridge 140 including a primer 146, powder 144 and the bullet 122; the method comprising:

a) shooting the bullet 122 by manually activating a trigger mechanism 110 to cause the firing pin 114 to strike the primer 146 from behind the cartridge 140, the strike causing an explosion of the powder 144 in the cartridge 140, the explosion causing the bullet 122 to fire from the cartridge 140, the bullet 122 to be propelled through the barrel 130 and the propellant gas to be generated into the barrel 130;

b) channeling the propellant gas generated by the explosion of the powder 144 in the cartridge 140, propellant gas rushing from the barrel 130 through the rear gas port 124 and into the rear piston area 126 immediately after the bullet 122 has passed the rear gas port 124, pressure caused by the propellant gas in the rear piston area 126 forcing and holding the piston 132, the connecting arm 120 and the bolt 116 forward, with the piston 132 being physically connected to the bolt 116 by the connecting arm 120 and the piston arm connector 134, thus inertial rearward movement of both the piston 132 and the bolt 116 is delayed due to the propellant gas pressure from the rear piston area 126 keeping the bolt 116 in a forward position immediately after firing of the bullet 122 until the propellant gas pressure in the barrel 130 is returned to near ambient; and c) channeling the propellant gas, as the bullet 122 passes the forward gas port 136 and is exiting out of the barrel 130, the propellant gas rushing through the forward gas port 136 and into the forward piston area 138, the propellant gas from the forward piston area 138 thus moving rearward and the larger diameter of the forward gas port 136 in comparison to the rear gas port 124 allowing the propellant gas pressure from the forward piston area 138 to overpower the propellant gas pressure from the rear piston area 126, with the propellant gas pressure from the forward piston area 138 forcing the piston 132, the connecting arm 120 and the bolt 116 rearward, the bolt 116 in its rearward movement functioning to extract and eject the empty cartridge 140 from the firearm.

In another embodiment of the method, the method further comprises the step of pushing forward the rearward-positioned bolt 116 with a recoil spring 128, the recoil spring 128 functioning to force the rearward-positioned bolt 116 forward again, after extraction and ejection of the empty cartridge 140 from the firearm, the forward-moving bolt 116 picking up another cartridge 140 from the magazine 112, and the bolt 116 and cartridge 140 being pushed forward to seat the cartridge 140 for another shot.

In yet an additional embodiment of the method, the method further comprises a bolt handle 118 connected to the bolt 116 to enable manually pulling the bolt 116 rearward in the firearm to facilitate initial loading and/or chamber inspection.

In another embodiment of the method, the firearm is selected from a group consisting of an automatic rifle, a semi-automatic rifle, an automatic carbine, a semi-automatic carbine, an automatic pistol, and a semi-automatic pistol.

The present application also relates to a firearm with both gas-delayed and stroke piston action, the firearm comprising a barrel 130, a bolt 116, a piston 132, a connecting arm 120, a rear gas port 124, a rear piston area 126, a forward gas port 136 having a greater diameter than the rear gas port 124, and a forward piston area 138, and an ammunition cartridge 140 including a primer 146, powder 144 and a bullet 122. The cartridge 140 is manually activated and fired, the bullet 122 separating from the cartridge 140 and being propelled through the barrel 130. When pressure from the propellant gas generated by the explosion of the powder 144 from the cartridge 140 flows into the rear gas port 124 and the rear piston area 126, the propellant gas pressure from the rear piston area 126 forces and holds the piston 132, the connecting arm 120 and the bolt 116 forward and then holding the piston 132 and the bolt 116 in a forward position, the piston 132 being physically connected to the barrel 130 by the connecting arm 120. Thus the inertial rearward movement of the bolt 116 is delayed due to the propellant gas pressure from the rear piston area 126 keeping the bolt 116 in a forward position immediately after firing of the bullet 122 until propellant gas pressure in the barrel 130 reaches the forward gas port 136 and the pressures in the barrel 130 return to near ambient. When the bullet 122 approaches the barrel 130 exit, propellant gas in the barrel 130 rushes from the barrel 130 through the forward gas port 136 and into the forward piston area 138. The propellant gas from the forward piston area 138 thus moves rearward and the larger diameter of the forward gas port 136 in comparison to the rear gas port 124 allows the propellant gas pressure from the forward piston area 138 to overpower the propellant gas pressure from the rear piston area 126, with the propellant gas pressure from the forward piston area 138 forcing the piston 132 and the bolt 116 rearward. The bolt 116 in its rearward movement functions to extract and eject the empty cartridge 140 from the firearm.

In another embodiment of the above firearm, once the bolt 116 is forced completely rearward, the bolt 116 is then manually forced forward to be in position for loading of another ammunition cartridge 140.

To verify these methods and configurations, the following experiments were conducted and described in the Examples below.

EXAMPLES

Example 1

Two embodiments have been built to prove the physical response of the dual, gas-delayed, stroke piston firearm action. The second embodiment shown in FIG. 3 differs slightly from the first embodiment shown in FIGS. 1A, 1B, and 1C and FIG. 4. The second embodiment shown in FIG. 3 is an earlier version of the firearm of the present application created for testing purposes, thus lacking certain elements, among them, the recoil springs 128, receiver 148 and the bolt handle 118. The second embodiment was built to determine if gas in the forward port 136 would be able to force the piston 132 and bolt 116 rearward after the barrel 130 pressures were low enough for safe cartridge 140 extraction. There was a series of test firings of the second embodiment. At initiation of the firing of the bullet 122 from the ammunition cartridge 140, one could see sparks (indicating propellant gases) that were escaping from the rear piston area 126 and the bolt 116 remained almost motionless. After the bullet 122 had already been absorbed into the target, sparks (indicating propellant gases) could be seen leaking from the forward piston area 138. At this point the rear bolt 116 of the second embodiment had been pushed completely rearward and had extracted the empty cartridge 140.

Example 2

With the second embodiment proving the principles of the firearm of the present application, a large scale first embodiment was developed which used a high powered ammunition cartridge 140. FIG. 1A shows an overview of the first embodiment. FIG. 1B is a close-up cutaway view of the midsection of the first embodiment seen in the overview of FIG. 1A. FIG. 1C is a close-up cutaway view of the forward section of the first embodiment seen in the overview of FIG. 1A. FIGS. 1A, 1B, and 1C show an external view of the first embodiment. FIG. 4 shows an internal view of the first embodiment. The internal component assembly seen in FIG. 4 fits within the tube receiver 148 shown in FIG. 1A. This first embodiment efficiently fired several rounds semi-automatically with a smooth extraction of the empty cartridges 140. All results indicated that the gas pressures were within safe limits by the time the bolt 116 began to move rearward and the empty cartridge 140 was extracted.

The first embodiment was successful. With minor changes to the ratios of the diameters of the rear gas port 124 and the forward gas port 136, the first embodiment proved to be a reliable and robust firearm.

While several embodiments have been described in detail, it will be apparent to those skilled in the art that the disclosed embodiments may be modified. Therefore, the foregoing description is to be considered exemplary rather than limiting.

What is claimed is:

1. A firearm with both gas-delayed and stroke piston action; the firearm comprising an internal component assembly including a barrel, a bolt, a piston, a piston connector, a connecting arm assembly, recoil springs, a rear gas port, a rear piston area, a trigger mechanism, a firing pin, a forward gas port having a larger diameter than the rear gas port, and a forward piston area, the internal component assembly fitting within a receiver; and the internal component assembly further including an ammunition cartridge including a primer, powder and a bullet, a forward end of the bullet being positioned immediately adjacent to the rear gas port at the back of the barrel;

wherein, when the trigger mechanism is manually activated, the firing pin strikes the primer from behind the cartridge, the striking of the primer causing an explosion of the powder, a firing of the bullet from the cartridge, and a generating of propellant gas in the barrel and into the adjacent rear gas port immediately after firing, the bullet separating from the cartridge and being propelled through the barrel;

wherein, when pressure from the propellant gas generated by the explosion of the powder in the cartridge flows into the rear gas port and the rear piston area, the propellant gas pressure from the rear piston area forces and holds the piston, the connecting arm, and the bolt in a forward position, the piston being physically connected to the bolt by the connecting arm and the piston connector, inertial rearward movement of the bolt is then delayed due to the propellant gas pressure from the rear piston area keeping the bolt in a forward position immediately after firing of the bullet until the propellant gas pressure in the barrel reaches the forward gas port and the propellant gas pressure in the barrel returns to near ambient;

wherein, when the bullet approaches the barrel exit, propellant gas rushes from the barrel through the forward gas port and into the forward piston area, the propellant gas thus moving rearward and the larger diameter of the forward gas port in comparison to the rear gas port allowing the propellant gas pressure from the forward piston area to overpower the propellant gas pressure from the rear piston area, with the propellant gas pressure from the forward piston area forcing the piston and the bolt rearward, the bolt in its rearward movement functioning to extract and eject the empty cartridge from the firearm;

wherein, once the bolt is forced completely rearward, the bolt is then forced forward by the recoil springs; the forward-moving bolt picking up another ammunition cartridge from the magazine, and the bolt and the cartridge being seated for another shot.

2. The firearm of claim 1, further comprising a bolt handle connected to the bolt to enable manually pulling the bolt rearward in the firearm to facilitate at least one of initial loading and chamber inspection.

3. The firearm of claim 1, wherein the firearm is selected from a group consisting of an automatic rifle, a semi-automatic rifle, an automatic carbine, a semi-automatic carbine, an automatic pistol, and a semi-automatic pistol.

4. A method of using propellant gases generated from shooting a bullet from a firearm to achieve both gas-delayed and stroke piston action; the firearm comprising an internal component assembly including a barrel, a bolt, a rear gas port, a rear piston area, a piston, a trigger mechanism, a firing pin, a forward gas port having a larger diameter than the rear gas port, a forward piston area, the internal component assembly fitting within a receiver; and the internal component assembly further including an ammunition cartridge including a primer, powder and the bullet, a forward end of the bullet being positioned immediately adjacent to the rear gas port at the back of the barrel; the method comprising:

a) shooting the bullet by manually activating a trigger mechanism to cause the firing pin to strike the primer from behind the cartridge, the strike causing an explosion of the powder in the cartridge, the explosion causing the bullet to fire from the cartridge, the bullet to be propelled through the barrel and the propellant gas to be generated into the barrel and into the adjacent rear as sort immediately after firing;

b) channeling the propellant gas generated by the explosion of the powder in the cartridge, the propellant gas rushing from the barrel through the rear gas port and into the rear piston area immediately after the bullet has passed the rear gas port, pressure caused by the propellant gas in the rear piston area forcing and holding the piston, the connecting arm and the bolt forward, with the piston being physically connected to the bolt by the connecting arm and the piston arm connector, thus the inertial rearward movement of both the piston and the bolt is delayed due to the propellant gas pressure from the rear piston area keeping the bolt in a forward position immediately after firing of the bullet until the propellant gas pressure in the barrel is returned to near ambient; and c) channeling the propellant gas, as the bullet passes the forward gas port and is exiting out of the barrel, the propellant gas rushing through the forward gas port and into the forward piston area, the propellant gas from the forward piston area thus moving rearward and the larger diameter of the forward gas port in comparison to the rear gas port allowing the propellant gas pressure from the forward piston area to overpower the propellant gas pressure from the rear piston area, with the propellant gas pressure from the forward piston area forcing the piston, the connecting arm and the bolt rearward, the bolt in its rearward movement functioning to extract and eject the empty cartridge from the firearm.

5. The method of claim 4, further comprising the step of pushing forward the rearward-positioned bolt with a recoil spring, the recoil spring functioning to force the rearward-positioned bolt forward, after extraction and ejection of the empty cartridge from the firearm, the forward-moving bolt picking up another cartridge from the magazine, and the bolt and cartridge being pushed forward to seat the cartridge for another shot.

6. The method of claim 4, further comprising a bolt handle connected to the bolt to enable manually pulling the bolt rearward in the firearm to facilitate at least one of initial loading and inspection.

7. The method of claim 4, wherein the firearm is selected from a group consisting of an automatic rifle, a semi-automatic rifle, an automatic carbine, a semi-automatic carbine, an automatic pistol, and a semi-automatic pistol.

8. A firearm with both gas-delayed and stroke piston action, the firearm comprising a barrel, a bolt, a piston, a connecting arm, a rear gas port, a rear piston area, a forward gas port having a larger diameter than the rear gas port, a forward piston area, and an ammunition cartridge including a primer, powder and a bullet, a forward end of the bullet being positioned immediately adjacent to the rear gas port at the back of the barrel;

wherein, when the cartridge is manually activated and fired, the bullet separates from the cartridge and is propelled through the barrel, and propellant gas is generated in the barrel and into the adjacent rear gas port immediately after firing;

wherein, when pressure from the propellant gas generated by the explosion of the powder in the cartridge flows into the rear gas port and the rear piston area, the propellant gas pressure from the rear piston area forces and holds the piston, the connecting arm and the bolt in a forward position, the piston being physically connected to the barrel by the connecting arm, thus inertial rearward movement of the bolt is delayed due to the propellant gas pressure from the rear piston area keeping the bolt in a forward position immediately after firing of the bullet until propellant gas pressures in the barrel reach the forward gas port and the pressures in the barrel return to near ambient;

wherein, when the bullet approaches the barrel exit, propellant gas in the barrel rushes from the barrel through the forward gas port and into the forward piston area, the propellant gas from the forward piston area thus moving rearward and the larger diameter of the forward gas port in comparison to the rear gas port allowing the propellant gas pressure from the forward piston area to overpower the propellant gas pressure from the rear piston area, with the propellant gas pressure from the forward piston area forcing the piston and the bolt rearward, the bolt in its rearward movement functioning to extract and eject the empty cartridge from the firearm.

9. The firearm of claim 8, wherein, once the bolt is forced completely rearward, the bolt is then manually moved forward to be in position for loading of another ammunition cartridge.

* * * * *